United States Patent [19]

Wade

[11] Patent Number: 4,665,881

[45] Date of Patent: May 19, 1987

[54] HEATED FUEL INJECTION SYSTEM

[75] Inventor: Wallace R. Wade, Farmington Hills, Mich.

[73] Assignee: Ford Motor Company, Dearborn, Mich.

[21] Appl. No.: 827,481

[22] Filed: Feb. 5, 1986

Related U.S. Application Data

[63] Continuation of Ser. No. 615,664, May 31, 1984, abandoned, which is a continuation of Ser. No. 334,944, Dec. 28, 1981, abandoned.

[51] Int. Cl.[4] ..... F02M 39/00

[52] U.S. Cl. ..... 123/557; 123/467; 123/447

[58] Field of Search ..... 123/557, 458, 467, 447

[56] References Cited

U.S. PATENT DOCUMENTS

| | | | |
|---|---|---|---|
| 1,464,253 | 8/1923 | Wales | 123/557 |
| 2,747,555 | 5/1956 | Brunner et al. | 123/557 |
| 3,868,939 | 3/1975 | Friese | 123/557 |
| 4,167,168 | 9/1979 | Yamamoto | 123/467 |
| 4,206,733 | 6/1980 | Gregory | 123/557 |
| 4,284,049 | 8/1981 | Chmela | 123/467 |
| 4,300,514 | 11/1981 | Schaich | 123/557 |
| 4,303,051 | 12/1981 | Weishaar | 123/557 |

*Primary Examiner*—Carl Stuart Miller

*Attorney, Agent, or Firm*—Robert E. McCollum; Clifford L. Sadler

[57] ABSTRACT

A heated fuel injection system includes a fuel injector assembly that receives the output of a diesel type fuel pump against a piston that normally biases an injector valve closed; the pump also supplying a fuel reservoir with high pressure fuel, the output of the reservoir being heated and fed to the injector valve to act upon it to move it open when the force of the piston acting against it is relieved by the pump output pressure as it increases to a predetermined level during the charging stroke; the fuel heat being derived from the engine exhaust gases during normal running operation, and by an electrical starter, during engine startup.

10 Claims, 2 Drawing Figures

HEATED FUEL INJECTION SYSTEM

This application is a continuation of application Ser. No. 615,664, filed May 31, 1984, now abandoned, which is a continuation of application Ser. No. 334,944, filed Dec. 28, 1981, now abandoned.

This invention relates in general to a diesel type fuel injection system. More particularly, it relates to one in which the fuel is heated prior to injection.

One of the primary objects of the invention is to provide a heated fuel injection system that will supply liquid fuel to the injector so that it can be accurately metered while at the same time providing pressure and temperature conditions that will convert the liquid to a vapor immediately upon discharge from the injector nozzle without necessitating the use of additional heat transfer. This improves the operating efficiency of the engine and provides a very accurate control of the volume of fuel flow.

A further object of the invention is to provide a heated fuel injection assembly in which the injector valve is moved open by the heated fuel which is then discharged, the assembly including a servo means that closes the injector valve and is moved away from the valve by fuel discharged from the diesel injection pump.

Another object is to provide a high pressure fuel reservoir that is refueled from the main fuel injection pump subsequent to the opening of the fuel injector.

A still further object of the invention is to provide a fuel injection system of the type described in which heater means is included to maintain the fuel to be discharged above the vapor flash point prior to injection; the source of heat being the engine combustion products or hot exhaust gases during normal running operation of the engine, and an electrical heater for starting purposes.

Figure 1:
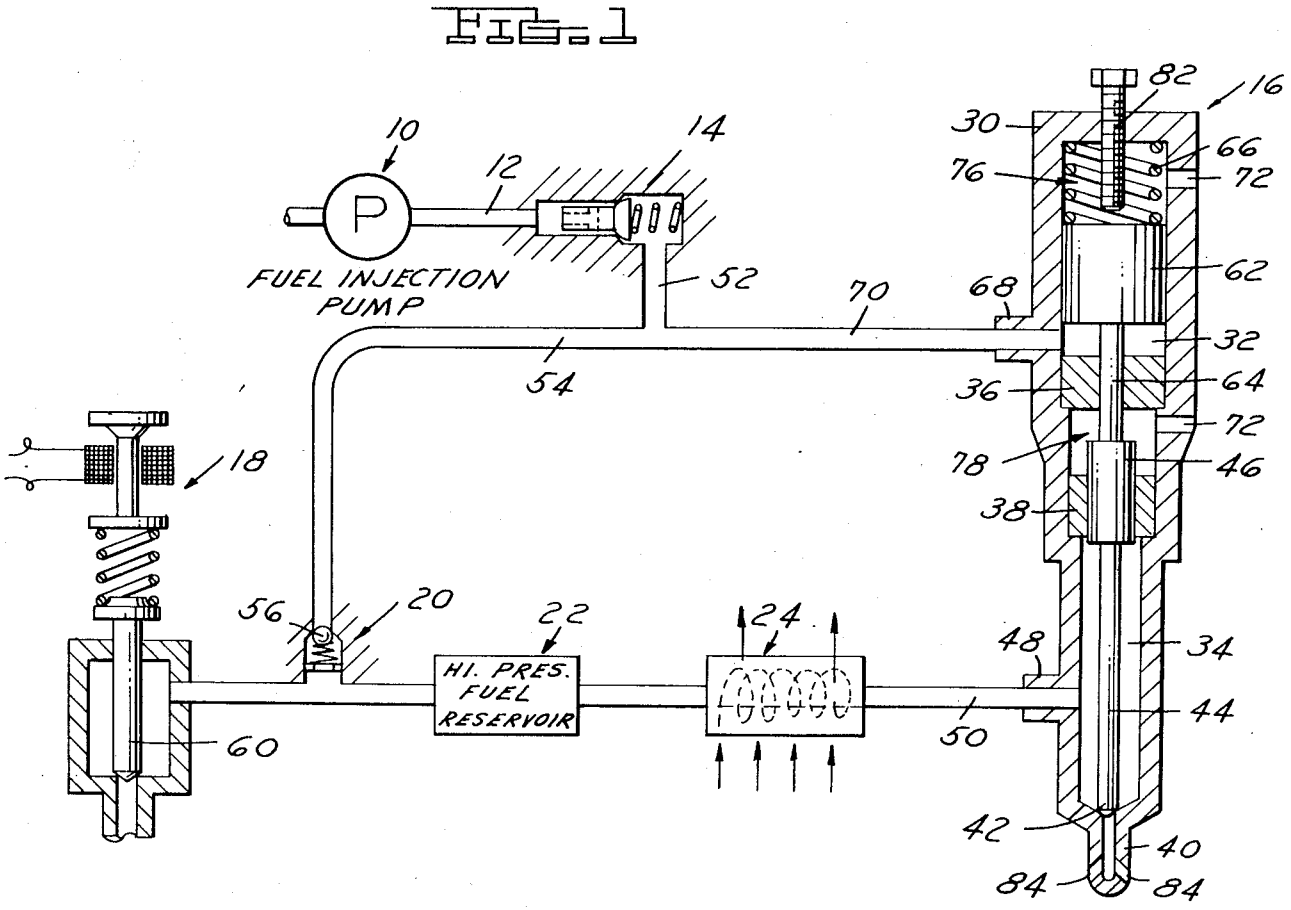
Figure 2:
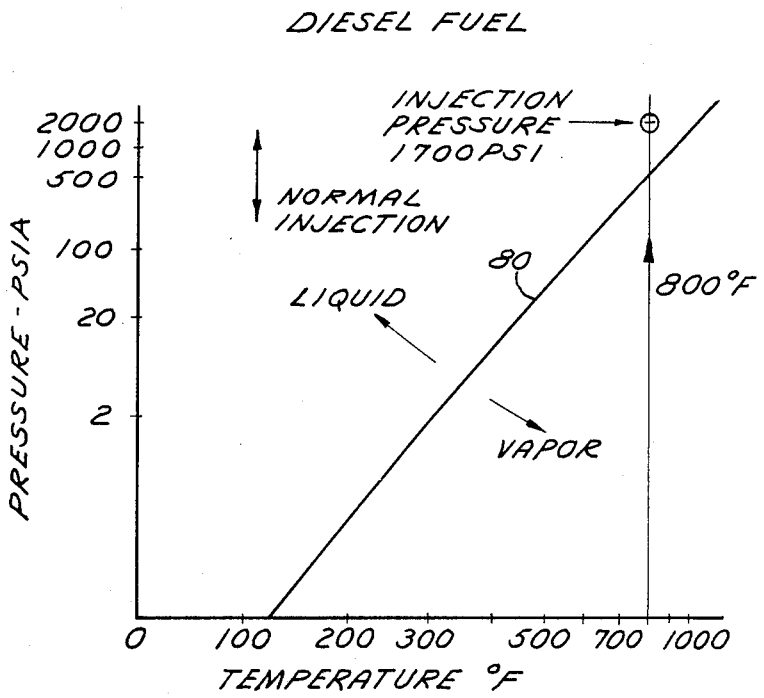

Other objects, features and advantages of the invention will become more apparent upon reference to the succeeding detailed description thereof, and to the drawings illustrating the preferred embodiment thereof; wherein, FIG. 1 schematically illustrates a fuel injection system embodying the invention; and FIG. 2 is a graphic illustration of the change in state of the fuel from a liquid to vapor and vice versa with changes in temperature and pressure conditions of the fuel.

Heated fuel injection systems of the general type described above are known. For example, U.S. Pat. No. 2,747,555, A. Brunner, shows in FIG. 3 a fuel distributor in which heated fuel is directed to a piston or servo (FIG. 2) that opens a valve to allow the heated fuel to move to the injector to open the same. During starting, an electrical heater 50 can be used. U.S. Pat. No. 1,464,253, Wales, describes a system in which an electrical resistor is used to heat the fuel during startup, the fuel being heated during running operation by the hot engine exhaust gases. Also, the fuel remains in a liquid state until discharged from the injector. U.S. Pat. No. 3,868,939, Friese et al, also shows the use of an electrical heater element.

None of the above prior art, however, shows an injection system of the type provided by this invention that contains an injector assembly having a fuel opened injector valve controlled by a servo operated by the fuel pump discharge pressure, the fuel to be injected being heated and supplied from a high pressure fuel reservoir replenished with fuel from the fuel pump subsequent to opening of the injector valve, the injector fuel being heated prior to discharge from the injector valve.

FIG. 1 shows a fuel injection system that includes a diesel type fuel injection pump indicated schematically at 10. The details of construction and operation of the pump are known and are, therefore, not given since they are believed to be unnecessary for an understanding of the invention. Suffice it to say that the pump would be of the jerk type providing intermittent discharges of fuel into an outlet line 12, the fuel progressively increasing in pressure during the pumping or charging stroke to a level above 1700 psi, for example. The fuel output flows past a known type of retraction valve indicated at 14 that assures a low residual pressure level during the non-pumping periods by retraction of a predetermined mass of the valve into the valve body in a known manner.

The system further includes a fuel injector assembly 16, a solenoid operated, variable pressure regulator 18, a high pressure check valve 20, a high pressure fuel reservoir 22, and a fuel heater indicated at 24.

The injector assembly 16 includes a hollow casing 30 divided into upper and lower fuel chambers 32 and 34 by a pair of spaced seal members 36 and 38, as shown. The lower fuel chamber 34 contains a fuel nozzle 40 from which fuel admitted to chamber 34 is discharged into the engine combustion chamber, not shown. The nozzle 40 cooperates with the lower valve end of a fuel injector valve 42 connected by a stem portion 44 to an enlarged actuator end 46. The latter is slideably and sealingly movable through the seal 38. The stem 44 is spaced from the outer casing to define chamber 34, which is connected by an inlet port 48 to a high pressure fuel line 50. The latter is supplied with fuel at high pressure from a high pressure fuel reservoir 22 past the heater indicated schematically at 24.

The high pressure fuel reservoir 22 is supplied with fuel from pump 10 through an outlet line 52 and a connecting line 54 past a one-wall ball type check valve 20. The force of spring 56 of check valve 20 in this case is set to maintain the valve closed until the pressure in the pump outlet line 52 is approximately 1700 psi. This assures that fuel reservoir 22 will be maintained at this high pressure level at all times. Regulation of the reservoir at this pressure level is assured by the variable pressure regulator 18. The latter consists of a solenoid controlled pressure regulating valve 60 that is set to operate at approximately a 1700 psi pressure level under normal circumstances, but can be varied by varying the voltage to the solenoid to control the time interval of actuation by the solenoid as desired to provide whatever pressure level is desired for injection of fuel into the combustion chamber.

Returning to the injector assembly 16, the upper chamber 32 contains a servo means in a form of a piston 62. The latter is slideably movable in the chamber 32 and has a stem actuator 64 slideably and sealingly movable through seal 36 into engagement with the upper end 46 of the fuel injector valve. Piston 62 is biased downwardly by the force of a spring 66 set to keep the injector valve closed until a 1500 psi pressure level is operable against the lower surface of piston 62. Chamber 32 in this case is supplied with fuel under pressure through an inlet port 68 connected by a line 70 to the outlet line 52 from retraction valve 14.

The injector assembly also includes a number of leak off ports 72 and 74 for the drainage of any fuel in chambers 76 and 78 that might leak past piston 62 and the upper end 46 of injector valve, respectively.

Completing the construction, the heater indicated schematically at 24 would be of a known type having a plenum surrounding the conduit 50 to heat the same by the exhaust gases or combustion products from the engine, as indicated, during running operation of the engine. During the startup of the engine, an electrical heater, not shown, could be incorporated to provide the necessary heat.

FIG. 2 graphically illustrates the change in state of the fuel under various temperature and pressure conditions. It will be seen that the fuel will remain as a liquid so long as the fuel pressure and temperature combinations remain to the left of the straight line curve 80.

In operation, in brief, initially the parts will be as shown. That is, the force of spring 66 will push piston 62 downwardly engaging the stem 64 with the upper end 46 of injection valve 42 moving it to its closed position as shown. During start up, the electrical heater, 24, initially will heat the fuel in line 50 to a desired level of, say, 800° F., for example. Assuming that the high pressure fuel reservoir 22 is filled with fuel at the pressure level of approximately 1700, psi as determined by the adjustment of the pressure regulator 18, the system is now in condition for operation.

When the pump moves through its charging stroke, the fuel pressure increases progressively opening retraction valve 14 and increasing the pressure in lines 52, 70 and 54. When the pressure of the fuel in chamber 32 reaches 1500 psi, for example, piston 62 will move upwardly against the force of spring 66 until it reaches a stop 82. With the force of piston 62 relieved from the upper end 46 of retractor valve 42, the high pressure heated fuel in line 50 and in chamber 34 now will move the lower end of upper land 46 and move the injector valve 42 upwardly to open nozzle 40. Thereafter, fuel at 800° F. and 1700 psi pressure level, will be discharged out through the nozzle openings 84. Instantaneously, as the pressure of the fuel drops, the fuel will change from a liquid to a vapor state (FIG. 2) without additional heat being required for this change of state. This provides increased efficiency of operation of the engine.

As fuel pump 10 continues to move through its charging stroke, the pressure will continue to rise in line 54 until it reaches the 1700 psi opening pressure level of the ball check valve 20. At this point, the fuel in line 54 will continue to feed reservoir 22 to maintain it full and at the pressure level of 1700 psi determined by the solenoid operated pressure regulator 18. This will maintain fuel in chamber 34 above the vapor flash point as indicated in FIG. 2, and, therefore, as a liquid until it is discharged from nozzle 40. When pump 10 again moves through its intake stroke, the retraction valve 14 will seat and the residual pressure in line 52 will decay. Spring 66 of the injector assembly 16 then will move piston 62 downwardly until stem 64 engages the upper end 46 of the injector valve 42 to move it downwardly to close the nozzle 40 and thereby terminate injection. As stated previously, during the running operation of the engine, the hot exhaust gases will pass over tube 50 containing the fuel from reservoir 22 and thereby maintain it at the desired 800° F.

While the invention has been shown and described in its preferred embodiment, it will be clear to those skilled in the arts to which it pertains that many changes and modifications may be made thereto without departing from the scope of the invention.

I claim:

1. A heated fuel injection system for a diesel engine including a single fuel pump having a fuel outlet intermittently charged with liquid fuel to progressively increase the fuel to a predetermined pressure level above the vapor flash point of the fuel, a fuel injection assembly including a fuel chamber having a fuel inlet and outlet and a fuel pressure responsive fuel injection valve movable therein to open the outlet in response to the pressure of fuel therein thereagainst, a plurality of control means including a heater and pressure regulating means to raise the pressure of the fuel in the chamber to the desired injection pressure level and to raise the temperature to a level above the vapor flash point of the fuel for that pressure level to maintain the fuel in a liquid state prior to injection while conditioning the fuel to flash vaporize immediately after injection in response to a drop in the pressure of the fuel upon expansion thereof, biasing force means moving the valve to a closed position independently of the pressure level of the heated fuel acting on the valve in a direction to open the same, and fuel pressure responsive actuating means movable in response to a fuel pressure level above a predetermined level lower than the injection pressure level to relieve the valve of the biasing force thereagainst and permit opening of the valve by the force of the fuel injection pressure thereagainst, decay of the pump output pressure to below the predetermined level permitting the biasing force means to again move the valve to a closed position.

2. A heated fuel injection system for a diesel engine including a fuel pump having a fuel outlet intermittently charged with liquid fuel to progressively increase the fuel to a predetermined pressure level above the vapor flash point of the fuel, a fuel injection assembly including a fuel chamber having a fuel inlet and outlet and a fuel pressure responsive fuel injection valve movable therein from a closed position to an open position to open the outlet in response to the pressure of fuel therein thereagainst, a plurality of control means including a heater and pressure regulating means operable at all times when the valve is in a closed position to maintain the pressure of the fuel in the chamber at a constant injection pressure level and temperature level above the vapor flash point of the fuel for that pressure level to maintain the fuel in a liquid state prior to injection while conditioning the fuel to flash vaporize immediately after injection in response to a drop in the pressure of the fuel upon expansion thereof, spring biasing means biasing the valve to a closed position, and fuel pressure responsive means connected to the pump outlet and responsive to a build-up of the fuel pressure thereagainst to a first level lower than the constant injection pressure level to render the spring means force on the valve ineffective, thereby permitting a concurrent opening of the valve by the fuel at the higher injection pressure level, decay of the pump output pressure to below the first lower level permitting the biasing force means to again move the valve to a closed position.

3. A heated fuel injection system for a diesel engine including a fuel pump having a fuel outlet intermittently charged with liquid fuel to progressively increase the fuel to a predetermined pressure level above the vapor flash point of the fuel, a fuel injection assembly including a fuel chamber having a fuel inlet and outlet and a fuel pressure responsive fuel injection valve movable therein from a closed position to an open position to open the outlet in response to the pressure of fuel therein thereagainst, a plurality of control means including a heater and pressure regulating means and fuel pressure reservoir operable at all times when the valve is in a closed position to maintain the pressure of the fuel in the chamber at a constant injection pressure level and the temperature at a level above the vapor flash point of the fuel for that pressure level to maintain the fuel in a liquid state prior to injection while conditioning the fuel to flash vaporize immediately after injection in response to a drop in the pressure of the fuel upon expansion thereof, spring biasing means located outside the chamber and operably connected to the valve biasing the valve to a closed position, and fuel pressure responsive means in opposing force position to the biasing means outside the chamber and connected to the pump outlet and responsive to a build-up of the fuel pressure thereagainst to a first level lower than the constant injection pressure level to overcome the biasing means rendering the spring means force on the valve ineffective, thereby permitting a concurrent opening of the valve by the fuel at the higher injection pressure level, decay of the pump output pressure to below the first lower level permitting the biasing force means to again move the valve to a closed position.

4. A system as in claim 1, the control means including a fuel pressure reservoir having an inlet connected to the pump outlet to supply fuel at high pressure to the reservoir, and check valve means in the inlet openable at a pressure level higher than the level of pressure for moving the fuel pressure responsive means whereby during each fuel pumping stroke initially the fuel injector valve is opened and subsequently the fuel reservoir is charged with fuel.

5. A system as in claim 1, the injector assembly including a hollow housing having the said fuel inlet adjacent one end and a fuel discharge nozzle adjacent thereto constituting the said fuel outlet, the pressure responsive means comprising servo means slidably mounted in the housing adjacent one end of the injector valve, the biasing means comprising spring means biasing the servo means against the injector valve towards a closed position, and passage means subjecting the servo means to the pressure of the fuel from the pump outlet in a force direction opposite to that of the spring means.

6. A system as in claim 4, the injector assembly including a hollow housing partitioned into first and second axially separated fuel chambers, the first chamber including the said assembly fuel inlet and outlet and injector valve, the second chamber including the actuating means constituting a piston means having a stem actuator extending into the first chamber and including a spring means constituting the biasing means and acting against one side of the piston means biasing the actuator against the fuel injector valve moving the valve to a closed position, and conduit means connecting the fuel under pressure from the pump outlet to the second chamber to the opposite side of the piston means to actuate the piston means in a direction permitting the reservoir fuel pressure to move the injector valve open.

7. A system as in claim 4, including a fuel pressure regulator in parallel flow arrangement with the inlet to the fuel reservoir and downstream of the check valve means for regulating the operating pressure level of the fuel in the reservoir.

8. A system as in claim 1, the control means including conduit means connecting the fuel at injection pressure to the injector assembly inlet, and heater means in the conduit means for heating the fuel passing through the conduit means to the injector assembly.

9. A system as in claim 8, the heater means being heated by the exhaust gases from the engine.

10. A system as in claim 9, the heater means including electrical heater means operable during starting operation of the engine.

* * * * *